US006837837B2

(12) United States Patent
Nethery

(10) Patent No.: US 6,837,837 B2
(45) Date of Patent: Jan. 4, 2005

(54) EXERCISE DEVICE

(76) Inventor: Robert Lee Nethery, 66 Margerum Rd., Trenton, NJ (US) 08620

( * ) Notice: Subject to any disclaimer, the term of this patent is extended or adjusted under 35 U.S.C. 154(b) by 534 days.

(21) Appl. No.: 09/992,682

(22) Filed: Nov. 19, 2001

(65) Prior Publication Data

US 2003/0096680 A1 May 22, 2003

(51) Int. Cl.[7] ..... A63B 21/00

(52) U.S. Cl. ..... 482/132; 482/95; 482/114; 482/908

(58) Field of Search ..... 482/51, 96, 97, 482/106–108, 114, 115, 118, 131, 132, 907, 908, 127, 141, 148; D21/681, 679, 662; 446/452; 280/206, 208, 64

(56) References Cited

U.S. PATENT DOCUMENTS 1,672,944 A * 6/1928 Jowett ..... 482/108
1,997,139 A 4/1935 Gardener et al.
2,069,384 A 2/1937 Ogden
2,821,394 A 1/1958 Barbeau
2,920,418 A 1/1960 Britt
3,231,270 A * 1/1966 Winer ..... 482/106
3,403,906 A 10/1968 Burzenski
3,616,794 A 11/1971 Gromala
3,913,908 A * 10/1975 Speyer ..... 482/106
4,171,805 A 10/1979 Abbott
4,225,132 A 9/1980 Archambault
4,339,127 A 7/1982 Mitchell
4,595,197 A 6/1986 Hagstrom et al.
4,629,184 A * 12/1986 Selkee ..... 482/106
4,743,018 A * 5/1988 Eckler ..... 482/106
4,822,035 A * 4/1989 Jennings et al. ..... 482/106
4,900,017 A 2/1990 Bold, Jr.
5,222,930 A * 6/1993 Bold, Jr. ..... 482/132
5,447,483 A 9/1995 Liang
5,690,594 A 11/1997 Mankovitz
5,921,900 A 7/1999 Mankovitz
6,010,430 A 1/2000 Mankovtiz
D422,038 S 3/2000 Iannetta
6,053,853 A 4/2000 Hinds
D428,630 S * 7/2000 Sandoval ..... D21/681
6,146,318 A 11/2000 Kuo

FOREIGN PATENT DOCUMENTS

SU 1818115 A1 * 5/1993 ..... A63B/21/072

* cited by examiner

*Primary Examiner*—Justine R. Yu
*Assistant Examiner*—Victor Hwang
(74) *Attorney, Agent, or Firm*—Watov & Kipnes, P.C.; Kenneth Watov

(57) ABSTRACT

An exercise device includes a pair of opposing axially-aligned elongated members each having a first end and a second end, first and second wheels being rotatably connected to each of the first ends of pair of the elongated members, respectively, and a connecting bar having each end operatively connected to the second end of each elongated member, the connecting bar being adapted for cooperation with the elongated members to selectively vary the distance between the elongated members, thereby controlling the width between the first and second wheels.

14 Claims, 6 Drawing Sheets

EXERCISE DEVICE

FIELD OF THE INVENTION

The present invention relates generally to fitness-related products, and more particularly to physical exercise devices.

BACKGROUND OF THE INVENTION

Exercise involves the active use of the body to build or maintain strength and endurance and to make the body healthier. This can include any form from running marathons to taking brisk walks, for anyone from the professional athlete to the sedentary person trying to get in shape. Exercise as a recreational activity, is a relatively modern development. In the past, many aspects of life in and out of the home involved physical labor. Today, relatively few occupations involve physical labor especially in developed nations such as the United States. As a result, physical activity is now often associated with recreational exercise. Increasingly, as larger segments of the population become less physically active, the incidence of preventable disease and health risk, including obesity, heart disease, diabetes, high blood pressure and cholesterol, and the like, has risen dramatically. It is well known that regular daily physical activity and exercise even at a minimal level, is extremely beneficial to one's health, and can significantly slow or even reverse the progression of many diseases.

For the foregoing reasons, there is a need for an exercise device that is capable of providing the user with a convenient outlet for physical activity to obtain health benefits. It is desirable to provide an exercise device that can be easily implemented and can accommodate users having different builds and gripping styles. Furthermore, it is desirable to provide an exercise device which allows the user to adjust the tension or exercise resistance through its wheels according to the user's physical capability and fitness level. It is further desirable to provide an exercise device which is cost efficient to construct and assemble with the minimal number of parts for extended operating life and simplicity in use.

SUMMARY OF THE INVENTION

The present invention is generally directed to an exercise device which allows the user to exercise the arms, legs, and the body and attain strength and aerobic benefits from such physical exercise. The exercise device is adapted to be gripped and reciprocally maneuvered by the user across a flat surface. The exercise device may be used on a flat surface that is horizontal or inclined. The exercise is further adapted to permit the user to adjust the width of the device according to the user's physical size and/or desired gripping style. In addition, the exercise device of the present invention also allows the user to adjust the tension or exercise resistance to conveniently vary the exercise amount and/or intensity over the flat surface.

In one aspect of the present invention, there is provided an exercise device which comprises:

a pair of opposing axially-aligned elongated members each having a first end and a second end;

first and second wheels being rotatably connected to each of the first ends of pair of the elongated members, respectively; and a connecting bar having each end operatively connected to the second end of each elongated member, the connecting bar being adapted for cooperation with the elongated members to selectively vary the distance between the elongated members, thereby controlling the width between the first and second wheels.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is directed to an exercise device useful for affording the user with an effective outlet for physical activity. The exercise device of the present invention is simple to use, and lightweight and portable for easy carry and compact storage. The exercise device is cost efficient to construct and comprises a minimal number of parts. In addition, the exercise device allows the user to adjust its width according to the user's size (shoulder width, for example) and/or desired gripping style. The exercise device is adapted to be gripped and reciprocally maneuvered by the user across a flat surface. The exercise device further allows the user to adjust the tension or exercise resistance to vary the concentrated amount of exercise in a convenient manner as will be described. The portability and the compactness of the exercise device of the present invention makes it transportable.

Figure 1:
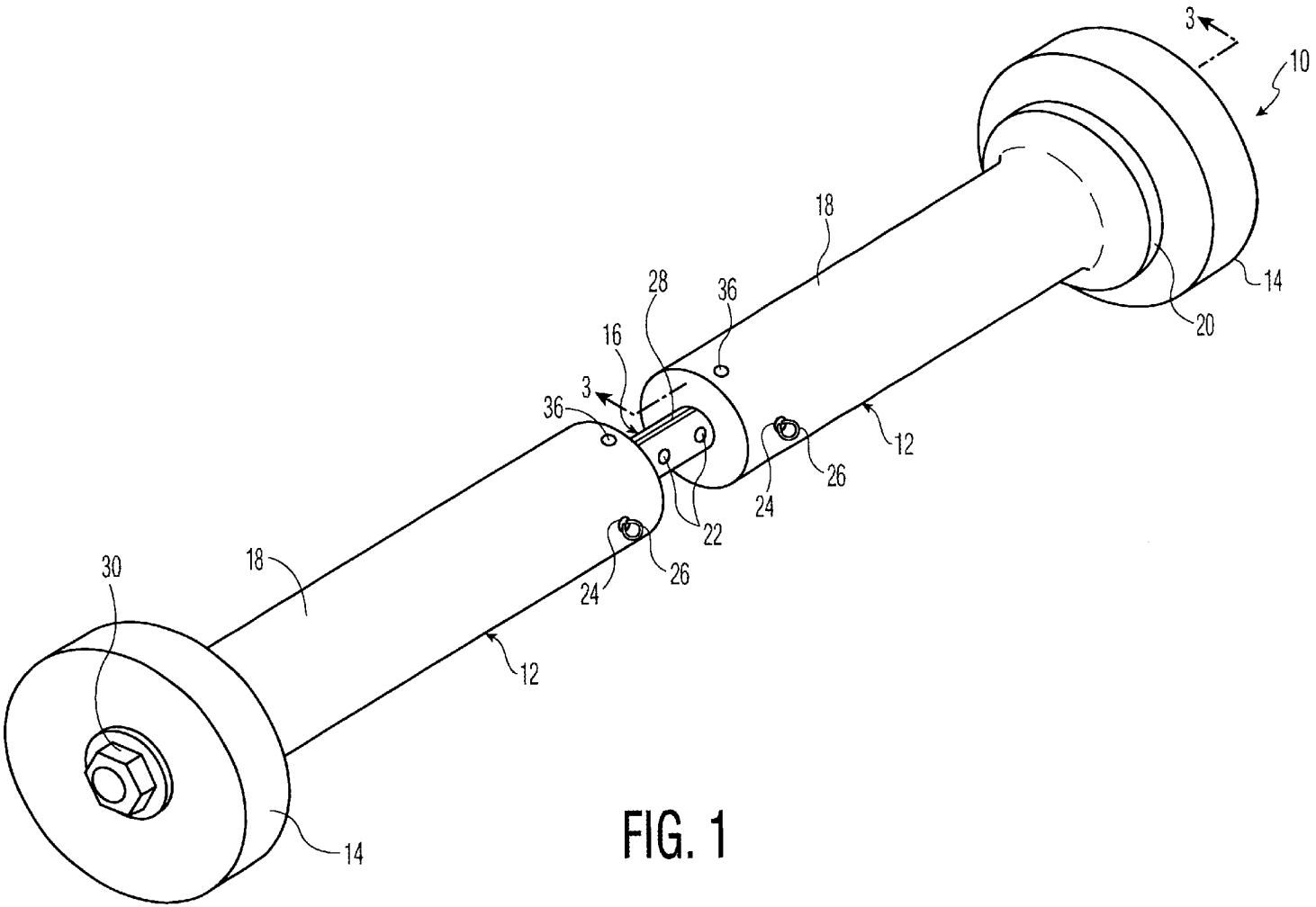
FIG. 1 is a perspective view of an exercise device for one embodiment of the present invention.

With reference to FIG. 1, an exercise device identified generally by reference numeral 10 is shown for one embodiment of the present invention. The exercise device 10 comprises generally a pair of opposed elongated members 12, a wheel 14 rotationally connected to each elongated member 12, and a connecting bar 16 located between the opposed elongated members 12. The connecting bar 16 is adapted for operative engagement with the elongated members 12 as will be described hereinafter. The device 10 is adapted to travel on the wheels 14 over a flat surface for a smooth rolling operation. The surface may be oriented in either a horizontal or inclined plane. The user holds the exercise device 10 and causes it to move back and forth on the flat surface, thereby manually exerting a force to produce healthy physical activity as will be described hereinafter.

The tension or rolling resistance may be adjusted in the wheels 14 to vary the concentrated amount of exercise in a convenient manner as described below. The wheels 14 may include an elastomeric material such as rubber and the like, at least encircling along the edge thereof to provide non-skid wheels as well as cushioning and quietness during exercise. The elongated members 12 each include a guide throughhole 36 which is described specifically in connection with FIG. 2 below.

The elongated members 12 are generally tubular and cylindrical in shape. The elongated members 12 may be composed of any suitable structurally rigid and durable material including metal, plastic, wood and the like. Each elongated member 12 also includes a gripping surface portion 18, and a flange portion 20 extending radially around the end thereof. The gripping surface portions 18 of the elongated members 12 provides gripping contact with the user's hands during exercise. The gripping surface portions 18 extends along the entire length of each respective elongated member 12 which is useful for accommodating varying grips and hand sizes. In one form, the gripping surface portions 18 may be padded or cushioned to provide the user with a comfortable grip. The flange portions 20 are located at the outer ends of respective elongated member 12 adjacent to an associated wheel 14, and serve to partition the user's hands from the rotating wheels 14 during exercise.

The connecting bar 16 is generally cylindrical, and connects the opposed elongated members 12 to one another for a secure engagement therebetween. The elongated members 12 can be moved back and forth along a portion of the connecting bar 16. This feature permits the user to adjust the width of the device 10 according to the user's build, particularly shoulder width and/or desired gripping style. By varying the gripping style, the user can exercise specific muscles selectively. In addition, the user can push or slide the elongated members 12 against each other for compact storage or transport. Alternative, the device 10 can be easily disassembled by detaching the elongated members 12 from the connecting bar 16 for more convenient packing or storage. The connecting bar 16 is preferably constructed from a durable, high strength material such as metal and plastic that can at least support the weight of the user, and is secured to the elongated members 12 in a manner described below.

The connecting bar 16 further includes a plurality of transverse throughholes 22 located along the length thereof. The throughholes 22 are adapted to align axially with an associated connecting hole or port 24 located in each of the elongated members 12, whereby a connecting pin 26 can be inserted through a connecting port 24 and its corresponding throughhole 22 for secure retainment therein. The inserted connecting pins 26 hold the elongated members 12, respectively, in place on the connecting bar 16, thus preventing movement of the elongated members 12 in either direction thereon. The exercise device 10 can easily be adjusted to a particular width, by removing the connecting pins 26, sliding each of the elongated members 12 to the desired positions on the connecting bar 16, and inserting the connecting pins 26 into the aligned connecting ports 24 and throughholes 22. The connecting bar 16 further includes a guide groove 28 extending along the length thereof and cooperates with the elongated members 12 to ensure proper alignment of the throughholes 22 and the corresponding connecting port 24, as will be described hereinafter.

Figure 2:
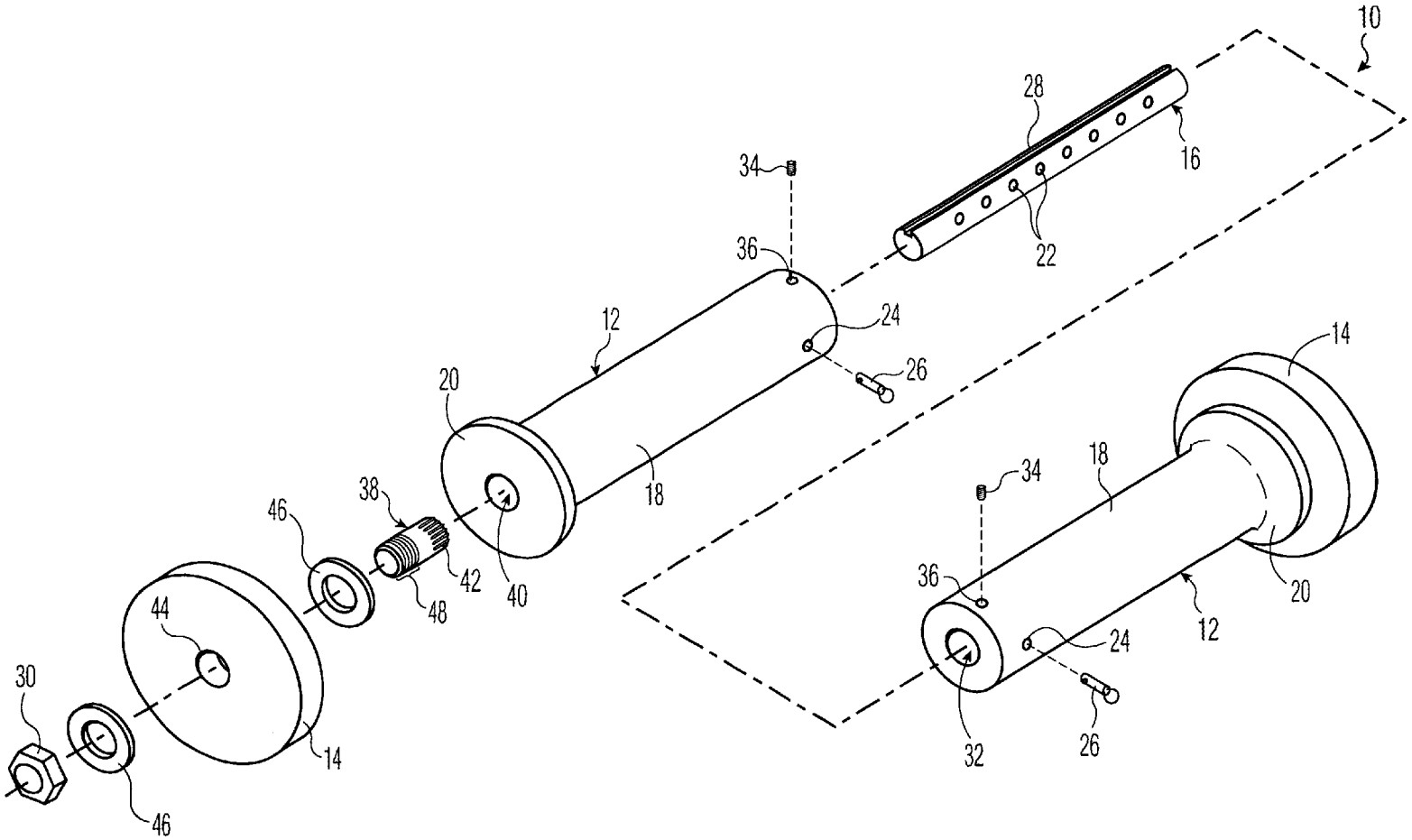
FIG. 2 is an exploded assembly view of the exercise device in accordance with the present invention.

With reference to FIG. 2, an exploded assembly view of the exercise device 10 is shown to illustrate the position of the components. The elongated members 12 each further include a recess 32 for receiving an end portion of the connecting bar 16. The cross sectional shape of the connecting bar 16 and the recess 32 of the elongated members 12 are dimensioned to provide a flush coupling therebetween. Each elongated member 12 includes a guide pin 34 extending partially into the recess 32 through a guide throughhole 36. With the elongated member 12 mounted on the connecting bar 16, the guide pin 34 is configured to fit into the guide groove 28 of the connecting bar 16. The guide groove 28 is configured to be slidable along its length with the guide pin 34. The cooperation of the guide pin 34 and the guide groove 28 ensures that the connecting bar 16 is properly oriented within the elongated member 12, and that the alignment between the throughholes 22 and the corresponding connecting port 24 is maintained.

Each elongated member 12 further includes an opening 40 adapted for receiving and retaining a proximal end portion of a spindle 38. The distal end of the spindle 38 projects from an associated elongated member 12, and connects to an associated wheel 14 for facilitating rotational movement. The proximal end of each spindle 38 includes a plurality of ribs 42 adapted for rigid frictional retainment in the opening 40 of the associated elongated member 12. An adhesive may also be applied between the proximal end of each spindle 38 and an associated opening 40 for secure coupling therebetween. The distal end of each spindle 38 includes a threaded portion 48 which extends through a centrally-located throughhole 44 of an associated wheel 14. A washer 46 is placed on each side of the wheel 14. The threaded portion 48 of the spindle 38 is adapted for threaded engagement with a fastener 30. The fastener 30 ensures that the wheel 14 is secured to exercise device 10. The fastener 30 is preferably a locking nut, however, it is noted that the fastener 30 is not limited as such and may include other forms of suitable fasteners.

Figure 3:
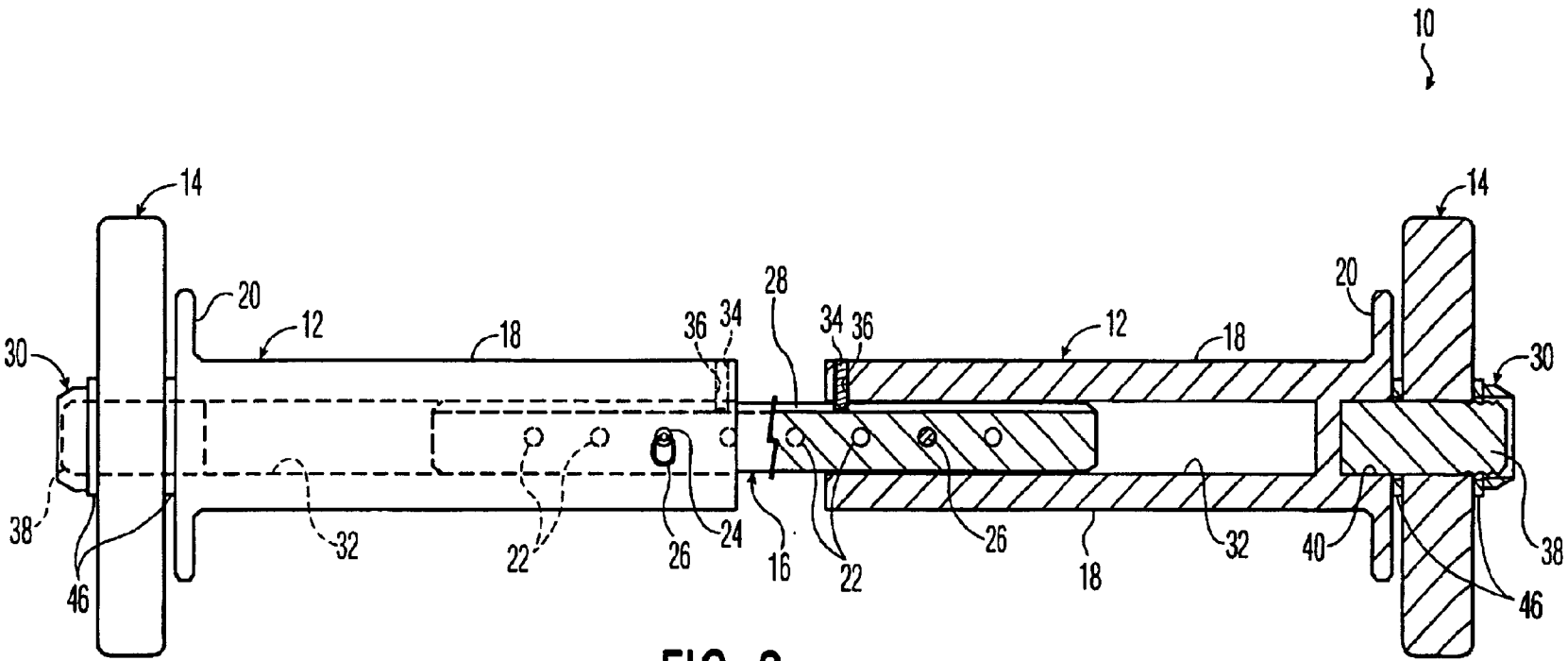
FIG. 3 is a partial cross sectional view of the exercise device taken along line 3—3 of FIG. 1 in accordance with the present invention.

Referring to FIG. 3, the end portions of the connecting bar 16 each reside, respectively, within the recess 32 of the elongated members 12, respectively. As noted above, the elongated members 12 are adapted to slide along the length of the connecting bar 16 to adjust the width of the exercise device 10. The guide pins 34 cooperates with the guide groove 28 of the connecting bar 16 to ensure proper alignment of the throughholes 22 with the connecting port 24 during adjustment. The exercise device 10 further allows the user to adjust the rotational resistance of the wheels 14. The fastener 30 can be tightened or loosened against the wheel 14 to increase or decrease, respectively, the amount of force required push the exercise device 10 across a flat surface. In this manner, the user can conveniently adjust the tension or exercise resistance of the exercise device 10 according to the user's physical capability and fitness level.

Figure 4:
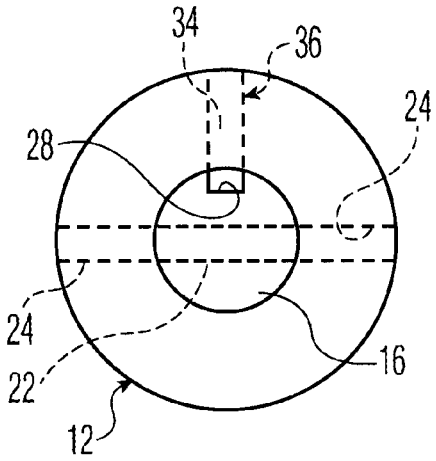
FIG. 4 is a side elevational view of an elongated member and a connecting bar in accordance with the present invention.

Referring to FIG. 4, the guide groove 28 of connecting bar 16 is shown aligned with a guide throughhole 36 in which a guide pin 34 has been inserted. The connecting port 24 extends through the elongated member 12 in alignment with the throughhole 22 of the connecting bar 16. The connecting pin 26 is adapted to be inserted through the connecting port 24 in one side, the associated throughhole 22, and at least preferably partially into the connecting port 24 in the opposing side, for secure retainment. Once the connecting pin 26 is inserted, the connecting bar 16 is locked longitudinally and radially into position with respect to the elongated member 12.

Figure 5:
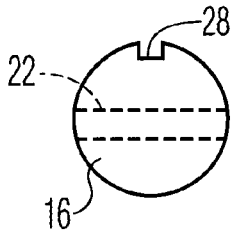
FIG. 5 is an end or side elevational view of the connecting bar in accordance with the present invention.

Referring to FIG. 5, a side elevational or end view of the connecting bar 16 is shown. The connecting bar 16 is substantial circular in cross section and includes the throughhole 22 and the guide groove 28 for aligning the throughhole 22 and the connecting port 24 as described above. The connecting bar 16 may be composed of any suitable durable, structurally rigid material such as metal, wood, plastic and the like.

Figure 6:
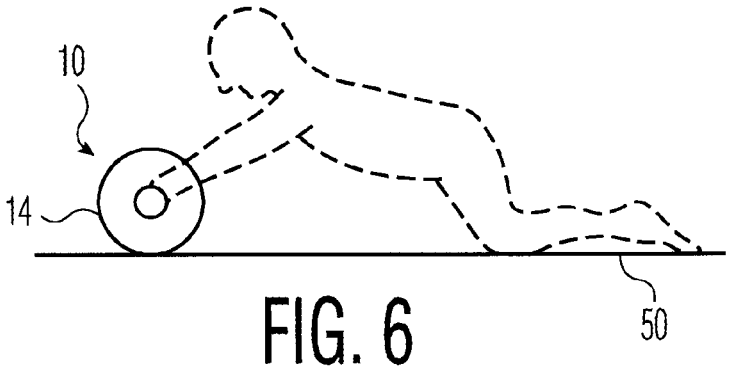
FIG. 6 is an illustration of the user in phantom in one position using the exercise device of the present invention.

Referring to FIG. 6, the exercise device 10 is shown during exercise by a user. The exercise device 10 is configured for use on a surface 50 preferably a flat surface which may be in a horizontal or inclined plane. The wheels 14 of the device 10 in contact with the surface 50, enables the device 10 to be moved in a back and forth direction. The user grasping the gripping surface portions 18 of the elongated members 12, can exert a force to cause the device 10 to proceed along the flat surface 50. The user in a kneeling position, can exercise different parts of the body depending on the grip and the movement by the user. It is noted that the user is not limited to this kneeling position and may use the exercise device 10 in other suitable body positions and gripping styles to effect exercise. With suitable exercise techniques, the user can effectively strengthen the appropriate muscles in the body, and obtain therefrom aerobic and cardiovascular benefits.

Figure 7:
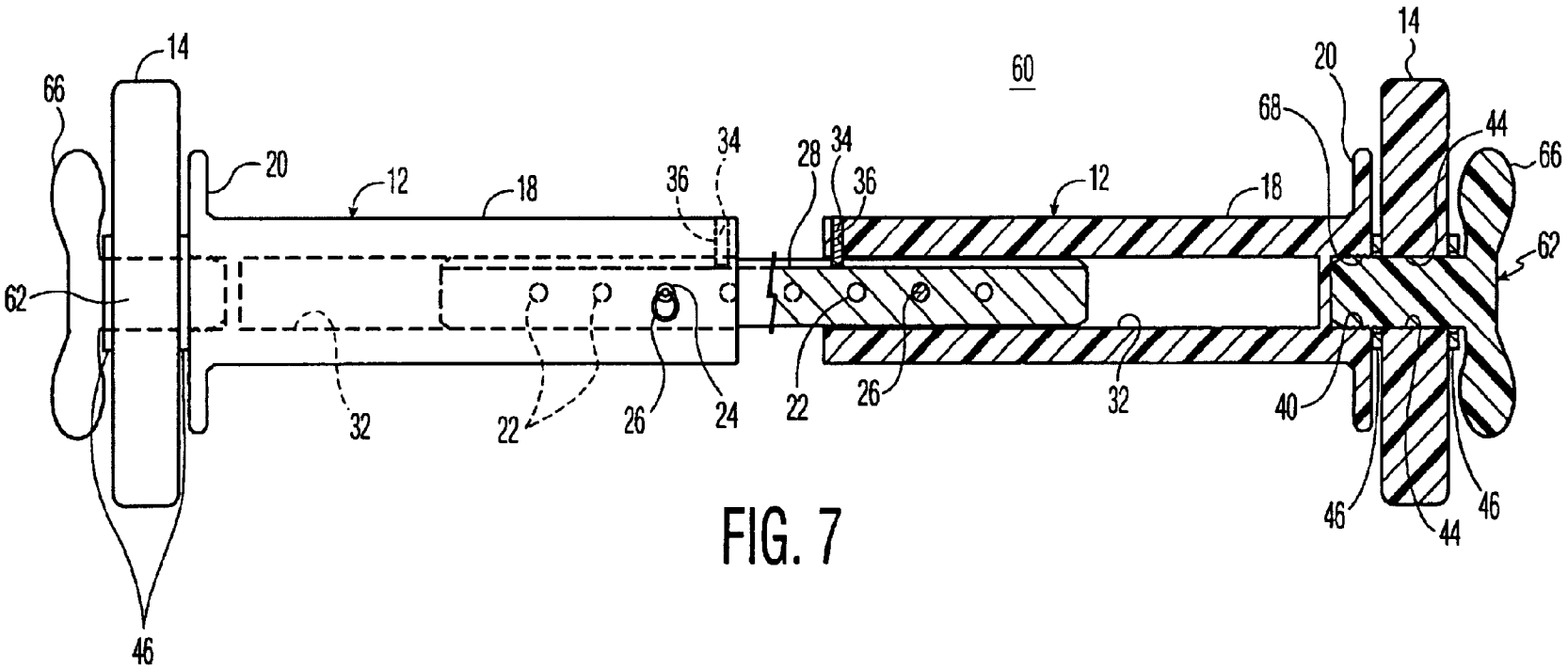
FIG. 7 is a partial cross sectional view of the device for a second embodiment of the present invention.

Referring to FIG. 7, an exercise device 60 for a second embodiment of the present invention is shown. The exercise device 60 is similar in many features to the previous embodiment. The exercise device 60 includes two removable spindles 62 for permitting easy disassembly of the wheels 14 for convenient packing and carrying. Each spindle 62 includes a bearing surface portion 44 for sliding contact with an associated wheel 14, a threaded portion 68, and a pair of wing shaped handles 66 at the opposite end from the threaded portion 68. The opening 40 in each elongated member 12 is threaded to accept the threaded portion 68 of the associated spindle 62 for secure coupling therebetween. The user can conveniently tighten or loosen the spindle 68 without the use of tools to remove the wheels 14 for disassembly or to adjust the tension or exercise resistance in the wheels 14. The washers 46 should be thick enough to prevent interference between the handle 66 and wheels 14.

Figure 8:
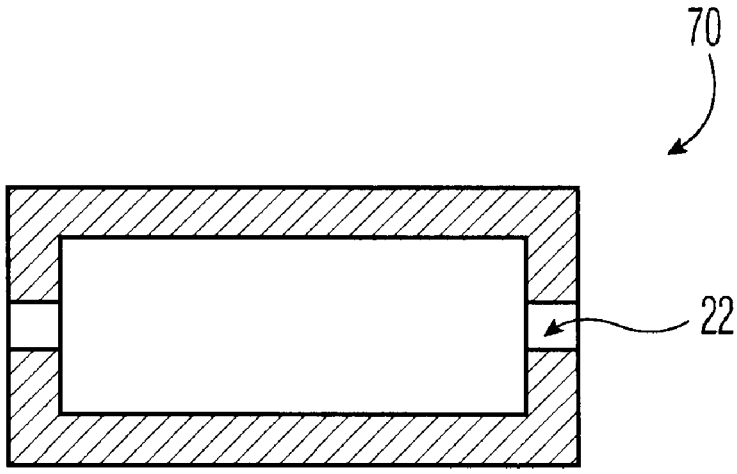
FIG. 8 is a cross sectional view of a connecting bar at a throughhole for a third embodiment of the present invention.
Figure 9:
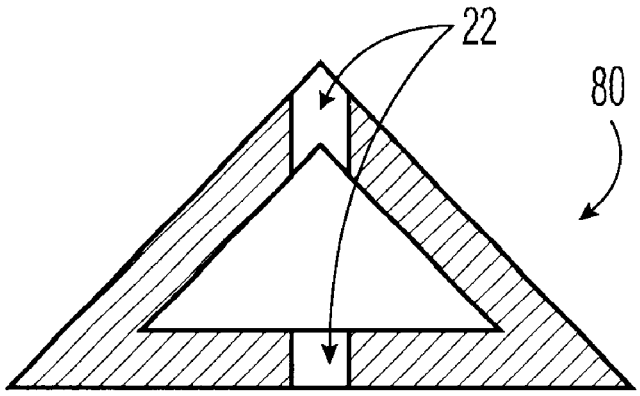
FIG. 9 is a cross sectional view of a connecting bar at a throughhole for a fourth embodiment of the present invention.

Referring to FIG. 8, a connecting bar 70 is shown for a third embodiment of the invention. The connecting bar 70 has a rectangular cross section for coupling into a corresponding rectangular recess in the elongated member (not shown). The rectangular cross section maintains the connecting bar 70 at an orientation where the throughholes 22 remain aligned with the connecting port 24 of the elongated member (not shown) without the use of a guide groove and pin assembly. In FIG. 9, the cross section of a connecting bar 80 is shown with a triangular shape useful for the same purpose. It is noted that a range of cross sectional shapes may be utilized to effectively maintain the proper orientation of the connecting bar within the elongated members.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. An exercise device comprising:

a pair of opposing axially-aligned elongated members each having a first end and a second end;

first and second wheels being rotatably connected to each of the first ends of pair of the elongated members, respectively; and a connecting bar having each end operatively connected to the second end of each elongated member, the connecting bar being adapted for cooperation with the elongated members to selectively vary the distance between the elongated members, thereby controlling the width between said first and second wheels, wherein the pair of elongated members each include a centrally located axially aligned recess extending from the second end thereof, said recess being adapted for reversibly receiving and retaining an end portion of the connecting bar.

2. The exercise device of claim 1, wherein the elongated members each include a gripping surface for a user's hand.

3. The exercise device of claim 1, further comprising a flange portion extending around a longitudinal axis of each of said pair of elongated members, proximate the respective first ends thereof adjacent to the associated wheel.

4. The exercise device of claim 1, further comprising a locking mechanism adapted for reversibly locking the depth of the connecting bar end portions retained within the recesses of the second ends of said pair of elongated members, respectively.

5. The exercise device of claim 4, wherein the locking mechanism includes:

a plurality of spaced apart throughholes extending transversely through the connecting bar and arranged serially along the length of the connecting bar;

a connecting port located through the circumference of each of said pair of elongated members proximate the respective second ends thereof, each said connecting port being alignable with the throughholes of an associated connecting bar end portion as its depth is varied within the recess of an associated elongated member; and a connecting pin adapted for snugly fitting into an aligned throughhole and connecting port to reversibly lock the associated connecting bar end portion within the recess at a depth.

6. The exercise device of claim 1, wherein:

the connecting bar includes a longitudinal groove; and each of said pair of elongated members include a projection extending from an inside surface of their respective recess, said projection being adapted for sliding engagement within the groove of the connecting bar.

7. The exercise device of claim 1, wherein:

the first end of each one of said pair of elongated members include a spindle extending away therefrom; and said first and second wheels each include a centrally-located throughhole for rotational mounting on the associated spindle.

8. The exercise device of claim 7, further comprising a pair of fasteners each adapted for securing the connection between said first and second wheels, and the spindle of the associated one of said pair of elongated members, respectively.

9. The exercise device of claim 8, wherein:

the spindle of each one of said pair of elongated members includes a threaded portion at the distal end thereof; and the pair of fasteners each include a nut adapted for threaded engagement with the threaded portion of the spindle against the associated one of said first and second wheels.

10. The exercise device of claim 7, wherein the spindle of each one of said pair of elongated members further includes a bearing surface upon which the associated one of said first and second wheels rotate.

11. The exercise device of claim 1, further comprising:

a pair of spindles each with a proximal end and a distal end;

a bore extending internally from the first ends of each of said pair of elongated members, said bore being adapted for receiving and retaining the proximal end of a respective one of said pair of spindles; and a centrally-located throughhole in said first and second wheels for rotational mounting on said pair of spindles, respectively.

12. The exercise device of claim 11, wherein:

each one of said pair of elongated members includes threads extending along the interior surface of its associated bore; and the proximal end of each one of said pair of spindles includes a threaded portion adapted for threaded engagement with the threaded bore of an associated one of the pair of elongated members.

13. The exercise device of claim 12, wherein each one of said pair of spindles includes a bearing surface portion between the threaded portion and the distal end thereof, said bearing surface being adapted for rotational engagement with and retainment of the associated one of said first and second wheels thereon.

14. The exercise device of claim 13, wherein each one of said pair of spindles includes a handle at the distal end thereof.

* * * * *